United States Patent [19]

Storm et al.

[11] 4,441,279

[45] Apr. 10, 1984

[54] PORTABLE SHARPENER

[75] Inventors: Nelson Storm, Rossville; Gregory A. Storm, Hoopeston, both of Ill.

[73] Assignee: E-Z Products, Inc., Rossville, Ill. ; by said Nelson Storm

[21] Appl. No.: 299,569

[22] Filed: Sep. 4, 1981

[51] Int. Cl.[3] ..... B24B 3/54

[52] U.S. Cl. ..... 51/69; 51/221 BS; 76/82.2

[58] Field of Search ..... 269/3; 76/82.2; 51/69, 51/221 BS

[56] References Cited

U.S. PATENT DOCUMENTS

| | | | |
|---|---|---|---|
| 1,464,442 | 8/1923 | Palser | 76/82.2 |
| 1,904,075 | 4/1933 | Petrich | 51/69 |
| 2,191,899 | 2/1940 | Primak | 51/69 |
| 2,528,943 | 11/1950 | Calabrese | 51/69 |
| 3,733,933 | 5/1973 | Longbrake | 269/3 |
| 3,819,170 | 6/1974 | Longbrake | 269/3 |
| 4,320,892 | 3/1982 | Longbrake | 51/221 BS |

*Primary Examiner*—Harold D. Whitehead

*Attorney, Agent, or Firm*—Witherspoon & Hargest

[57] ABSTRACT

A portable blade sharpening device having a vise to grip the blade, a guide bracket attached to the vise and a tool having a guide rod cooperating with the guide bracket to bevel the blade.

5 Claims, 8 Drawing Figures

PORTABLE SHARPENER

BACKGROUND AND OBJECTS

This invention relates to blade sharpeners and more particularly to portable units which are hand held and on which the sharpening angle is pre set.

There are many portable blade sharpeners on the market today. All of them allege certain advantages over their competition and it is very likely true that a specific type of sharpener might well be an excellent device for a single function. What is needed is a portable blade sharpener which will be universal in nature so as to provide wide utility in the blade sharpening field.

One of the most interesting patents with respect to the present invention is Longbrake U.S. Pat. No. 3,819,170 issued June 25, 1974 entitled "Portable Sharpener". In this patent the guide bracket has a plurality of holes adapted to receive a rod connected to the abrasive stone. Obviously the height of the hole in the bracket determines the sharpening angle. Unfortunately the geometry of this arrangement is such that the true desired angle can only be acheived by straight back and forth movement of the stone over the blade. If the stone pivots substantially to either side of the guide bracket the desired angularity is changed.

The problems of pivoting a sharpening stone and yet maintaining the desired sharpening angle is dealt with in Brougher U.S. Pat. No. 1,750,504. This problem is handled by making certain that the rack 18 which meshes with pinion 17 is concentric with the pivot 13. Thus the distance is always the same and angularity is constant.

In view of the foregoing, it is an object of this invention to provide a portable sharpening device which has a minimum number of parts without losing any of its functional characteristics.

It is another object of this invention to provide a portable sharpening device capable of being used to sharpen scissors and bladed devices such as knives.

It is yet another object of this invention to provide a portable blade sharpening device wherein the guide bracket will provide movement over substantially the length of the blade while still maintaining the desired angle.

The above and additional objects and advantages will become more apparent when taken in conjunction with the following detailed description and drawings showing preferred embodiments of this invention.

IN THE DRAWINGS

FIG. 1 is a perspective view of the basic sharpener unit as it is used in sharpening the blade of a pocket knife, FIG. 2 is a side elevational view of the sharpener shown in FIG. 1 with the knife removed for clarity, FIG. 3 is an end view of the sharpener of FIG. 1 with the knife removed, FIG. 4 is a side elevational view of the sharpener unit equipped and arranged for scissor sharpening, FIG. 5 is a plan view of the guide arm member used in the embodiment of FIG. 4, FIG. 6 is an end elevational view of the sharpener equipped and arranged to sharpen a wood chisel, FIG. 7 is a side elevational view of the embodiment of FIG. 6 with the grinding stone removed, and FIG. 8 is an end view of the grinding stone showing the arrangement of the three different stones and the member on which they are mounted.

DETAILED DESCRIPTION

Figure 1:
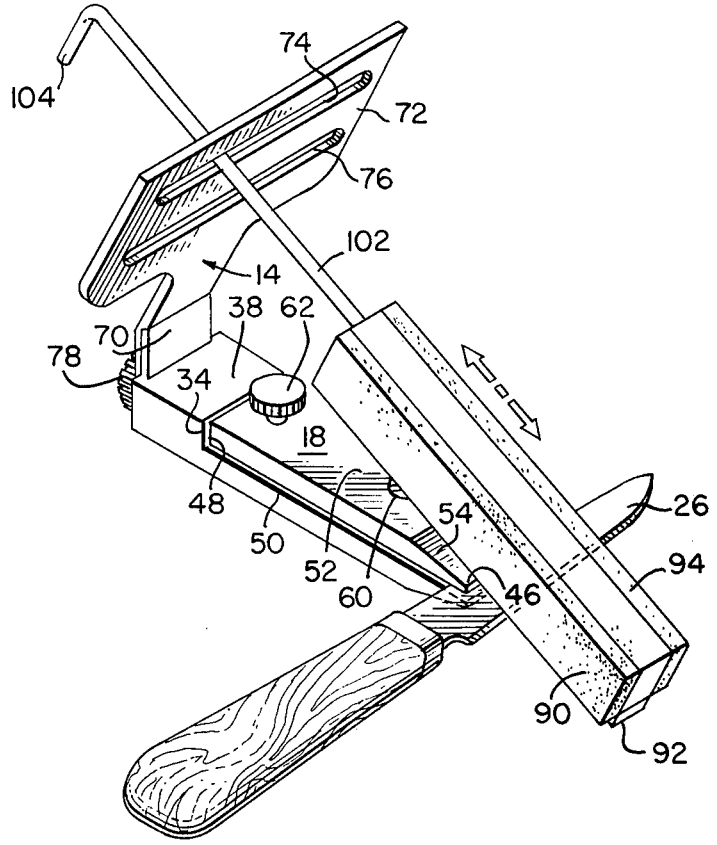
Figure 3:
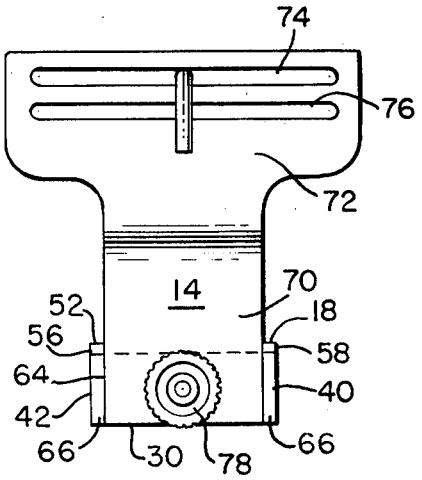
Figure 2:
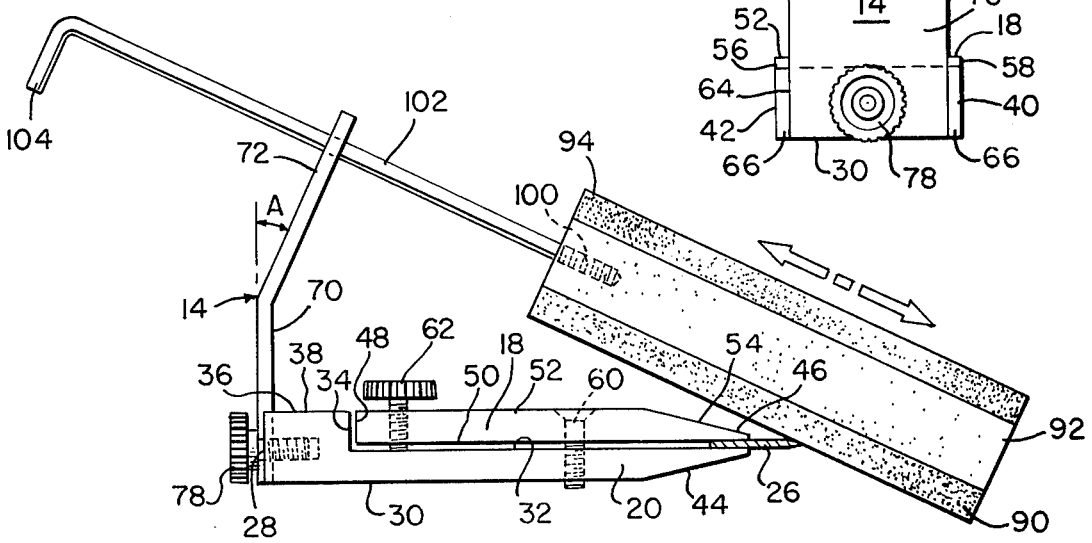

The basic portable blade sharpening device is best illustrated in FIGS. 1–3. More particularly, the blade sharpening device 10 comprises a vise 12 with a guide bracket 14 extending upwardly from one end thereof and a sharpening tool 16 for sharpening the knife blade 22 at the desired angle.

The vise 12 has an upper jaw 18 and a lower jaw 20 for gripping the blade 22 of the knife 24 as shown in FIG. 1. The lower jaw 20 has a forward end 26 and a rearward end 28 with a bottom 30 extending from one end to the other. A flat jaw surface 32 extends rearwardly from the front end 26 and terminates at a vertical upstanding shoulder surface 34. A flat upper surface 36 extends from the rearward end 28 forwardly to where it intersects vertical shoulder 34 above the flat jaw surface 32, thereby forming a positioning body portion 38 bounded by the flat upper surface 36, the rearward end 28, the rearward portion of the bottom 30 and the vertical shoulder surface 34. Generally parallel sides 40 and 42 connect the bottom 30 with the flat upper surface 36, flat jaw surface 32, rearward end 28 and vertical shoulder surface 34. The forward end portion 44 is tapered inwardly from the bottom 30 toward the front end 26 so as to provide adequate clearance for the sharpening routine.

An upper jaw 18 is adjustably mounted on the lower jaw 20 and comprises a forward end 46 and a rearward end 48 with a flat bottom 50 extending from end to end to form the jaw surface for the upper jaw 20. The jaw top 52 extends from end to end with its forward end portion 54 being tapered from the top toward the bottom 50 to form forward end 46. The upper jaw 18 has generally parallel sides 56 and 58 which are substantially aligned with corresponding sides 42 and 40 respectively of the lower jaw 20.

The upper jaw 18 is secured to lower jaw 20 by means of a screw 60 which is positioned in upper jaw 18 adjacent its forward end 46 with its headed end portion threadably mounted in the lower jaw 20. Screw 60 tends to hold flat bottom 50 of the upper jaw 18 spaced from the flat jaw surface 32 of lower jaw 20 in a generally parallel manner. Near the rearward end 48 of upper jaw 18, an adjusting screw 62 threadably extends through the upper jaw 18 from top 52 to bottom 50 and into engagement with the jaw surface 32 of lower jaw 20. Rotation of adjusting screw 62 varies the distance between confronting jaw faces and causes a somewhat pivoting action about screw 60 thereby controlling the gripping action between the confronting jaw faces of the forward ends 26 and 46. A rubber washer may be placed around screw 60 between the jaws if desired.

Referring to FIG. 3, the rearward end 28 of lower jaw 20 is provided with a vertical recess 64 bounded by vertical shoulders 66 extending throughout the height of the lower jaw portion at the rearward end 28. A guide bracket 14 is attached to the rearward end 28 of the lower jaw 20. This bracket comprises a rectangular guide arm 70 sized to fit between shoulders 66—66 on the rearward end 28 of the lower jaw 20. A guide plate portion 72 extends upwardly from the guide arm 70, said guide plate being substantially wider than the guide arm 70 and provided with two parallel spaced guide slots 74 and 76. As best shown in FIG. 2, the guide bracket 14 has its guide plate portion 72 bent at a slight angle A generally corresponding to or approximating the angle at which the sharpening is to be accomplished. The guide bracket 14 is secured to the rear end 28 by means of a headed screw 78 threadabley received in the rear end portion of the lower jaw 20.

Figure 8:
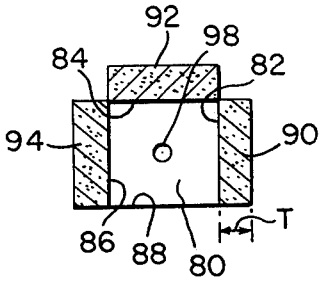

Referring to FIGS. 1, 2 and 8 the sharpening tool 16 comprises a longitudinal base 80 which is square in cross section thereby forming four longitudinally extending sides 82, 84, 86, 88 all of which are of the same size. Three of the sides, namely sides 82, 84 and 86 are each provided with an abrasive stone 90, 92 and 94 of specific grade. These stones are sized so as to be coextensive with the side and all have the same thickness designated "T". A threaded hole 98 is formed in the center of the base 80 to receive the threaded end 100 of guide rod 102. The free end of guide rod 102 is provided with a bent over portion 104 to aid in handling the rod and associated stone assembly. The guide rod 102 slides in either slot 74 or 76 depending upon the angle of cut desired.

In use, with the vise upper and lower jaws assembled and the guide bracket attached to the lower jaw; a knife blade 22 is gripped by the confronting faces of the upper and lower vise jaws with about ½ inch of the knife blade extending from the vise as shown in FIG. 1. The sharpening tool rod is positioned in one of the guide slots depending upon the cutting angle desired. After the desired sharpening is performed on one edge of the knife blade, the guide bracket is reversed so that it extends below the vise. In actual practice the vise is rotated 180 degrees and the guide bracket is repositioned to receive the sharpening tool guide rod to sharpen the other side of the knife blade. Such procedure may be continued through coarse, medium and fine stone to produce a very sharp and even edge.

Figure 5:
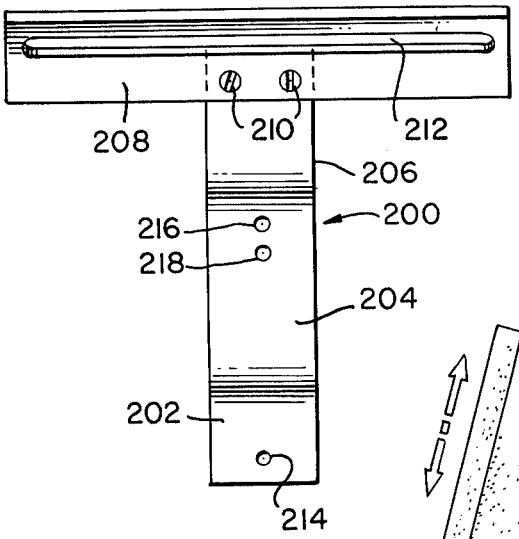
Figure 4:
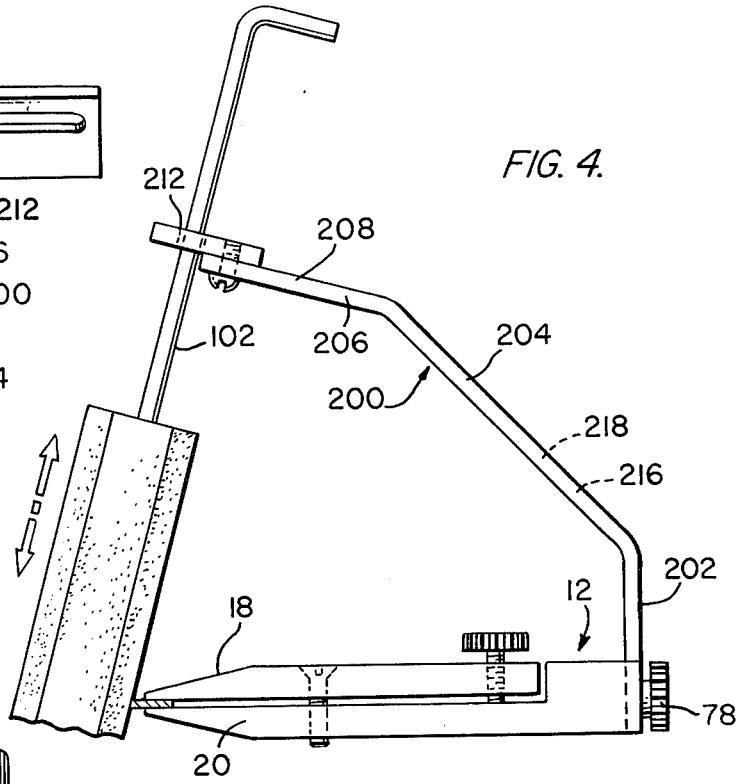

FIGS. 4 and 5 illustrate another embodiment of this invention which is particularly adapted for sharpening the blades of scissors. This embodiment employs the same vise combination as in the embodiment of FIG. 1, the difference residing in the guide bracket. In this embodiment guide bracket 200 comprises a support portion 202 with angularly positioned arm portion 204 extending from one end thereof. A body portion 206 extends from the end of arm portion 204 and at its end has a transverse guide bar 208 affixed thereto by means of screws 210. The guide bar 208 is substantially wider than the support portion 202 and is provided with a guide slot 212 extending throughout the width of the guide bar 208. The guide support portion 202 is provided with a hole 214 to receive screw 78 for attaching it to the vise 12 in the same manner as guide bracket 14 of FIG. 1. In addition the guide arm portion 204 is provided with a pair of spaced holes 216 and 218 to be used in attaching the guide bracket 200 to vise 12 when the device is to be used to sharpen knife blades.

In use for sharpening of scissors, a scissor blade is gripped between vise jaws 18 and 20 so that the edge to be sharpened extends outwardly from the ends 26 and 46 of the vise jaws 18 and 20. The same sharpening tool 16 used in embodiment of FIG. 1 is also employed in this embodiment. More particularly, guide rod 102 is positioned in guide slot 212 and one of the sharpener stones 90, 92, 94 is brought into contact with the blade edge to be sharpened. As before straight reciprocating strokes are preferred as the stone travels along the length of the scissor blade and the guide slot 212.

Figure 7:
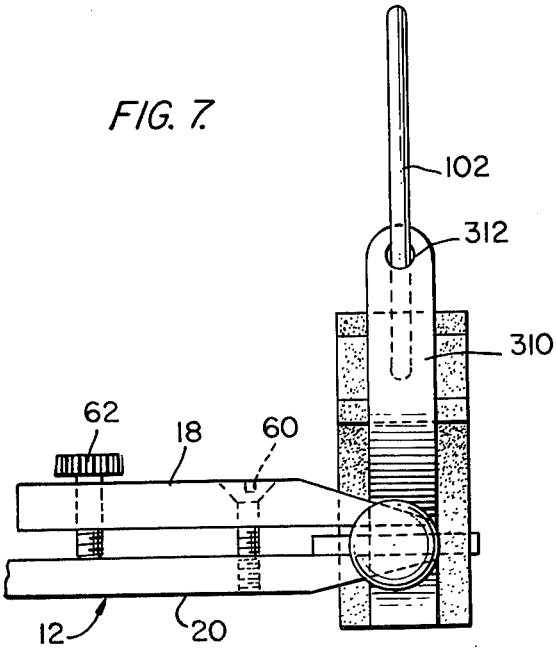
Figure 6:
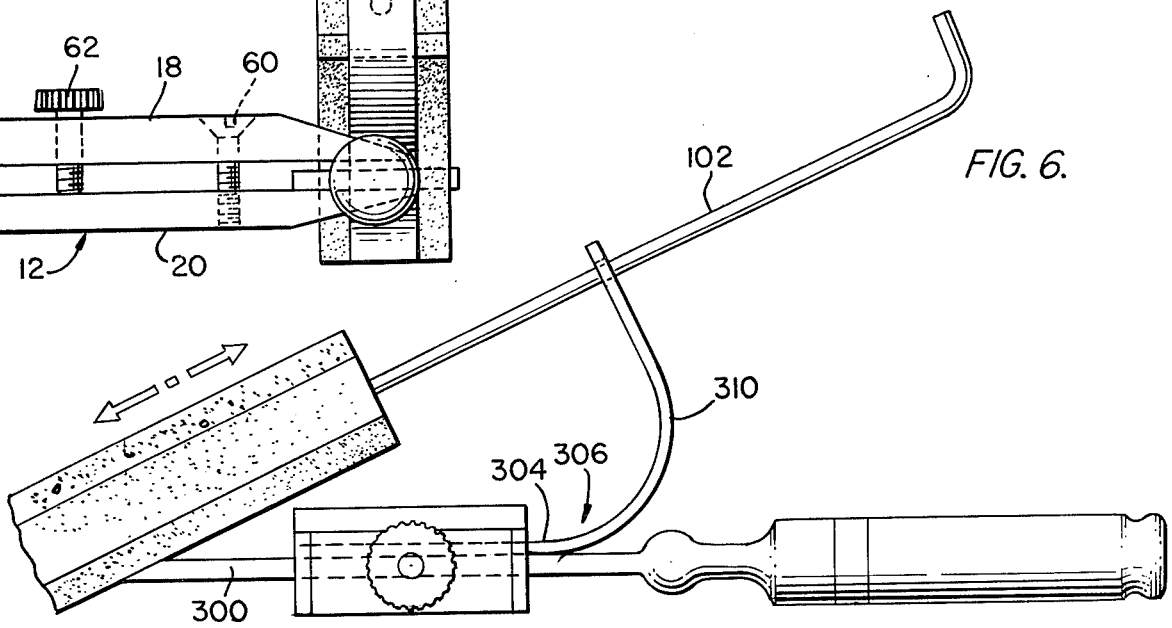

Yet another embodiment is illustrated in FIGS. 6 and 7 where means are provided for sharpening a wood chisel. As shown, the vise 12 is the same as that used in both of the earlier disclosed embodiments and comprises upper and lower jaws 18 and 20 respectively which are made adjustable by means of screw 60 and adjusting screw 62. The chisel blade 300 is positioned between the upper and lower vise jaws 18 and 20. Next a flat portion 304 of guide bracket 306 is positioned between the upper jaw 18 and the chisel blade 300. With the chisel blade 300 and flat portion 304 of guide bracket 306 so positioned the two jaws are brought together by screw 62 to retain the guide bracket and chisel blade in fixed position with respect to each other and the vise itself. It should be noted that the upwardly curving arm 310 of guide bracket 306 has a hole 312 adjacent its top end to receive guide bar 102 of the sharpening tool. Since the height of the hole 312 is constant, changing of the angle of cut is produced by the positioning of the chisel blade's angular surface with respect to the guide bracket and hole to provide desired sharpening angle. Here again a generally straight reciprocating stroke of the sharpening tool is desired.

What is claimed is:

1. A portable hand held blade sharpening device comprising a vise having an upper and a lower jaw adapted to grip the blade to be sharpened therebetween, the lower jaw including a forward end and a rearward end, a bottom extending from end to end, a flat upper surface extending rearwardly from the front end and terminating in a vertical upstanding shoulder surface, a flat surface extending from the rear end forwardly to intersect the vertical shoulder above the flat upper surface thereby forming a positioning body portion bounded by the flat surface extending from the rear end, the bottom, the rearward end and the vertical upstanding shoulder, generally parallel sides connecting the bottom with the flat surface and the flat upper surface to form a generally rectangular vise lower jaw, an upper jaw adjustably mounted on the lower jaw, said upper jaw comprising a forward end and a rearward end, a top extending from end to end, a flat bottom surface extending from end to end to form a bottom jaw surface generally coextensive with the flat upper surface of the lower jaw, generally parallel sides connecting the top and flat bottom surface to form a generally rectangular vise upper jaw, screw means adjacent the forward ends of the upper and lower vise jaws to control and vary the space between the confronting jaw surfaces, screw means carried by one of the jaws adjacent the rearward end thereof to engage the confronting jaw surface of the other jaw to cause pivoting of one jaw with respect to the other about the screw means adjacent the forward ends of the jaws, the rearward end of the lower jaw being provided with a central recess bounded by vertical shoulders extending throughout the height thereof, a guide bracket affixed to the rearward end of the lower jaw in said recess, said guide bracket comprising a rectangular guide arm sized to fit into the central recess in the rearward end of the lower jaw, said arm having a bottom and a top, a guide plate extending from the top of the guide arm, said guide plate being inclined toward the forward end of the lower jaw, said inclination commencing when the guide plate attaches to the guide arm, the guide plate being provided with two parallel guide slots extending transversely of the guide plate and parallel to the end of the lower jaw, screw means for affixing the guide bracket to the rear end of the lower jaw, a sharpening tool cooperating with the vise and guide bracket, said tool comprising a longitudinally extending base having a square cross section thereby forming four equi-sized side faces, at least one of said faces being provided with an abrasive stone sized to be coextensive with said face, one end of the base being provided with a centrally threaded hole, a guide rod having a threaded end mounted in said threaded hole whereby every abrasive stone mounted on the side faces will be equi-distant from the center of the base, the guide rod fitting in and passing through one of the guide slots to control the angle of the abrasive stone with respect to a plane projected outwardly from between the confronting surfaces of the upper and lower jaws, whereby when a blade is held between the upper and lower jaws the blade will be positioned in the aforesaid plane so that the angle of sharpening will be determined by the transverse guide slot in which the guide rod is positioned.

2. The invention as set forth in claim 1 and wherein the guide plate is substantially wider than the guide arm whereby a greater length of blade may be sharpened at one setting.

3. The invention as set forth in claim 2 and wherein the forward end portions of the lower and upper jaws are tapered toward the confronting jaw faces to provide clearance for the abrasive stone when the sharpening tool is assembled with the vise and guide bracket.

4. A portable hand held blade sharpening device comprising a vise having an upper and a lower jaw adapted to grip the blade to be sharpened therebetween, the lower jaw including a forward end and a rearward end, a bottom extending from end to end, a planar upper surface extending rearwardly from the front end and terminating in a vertical upstanding shoulder surface, a flat upper surface extending from the rear end forwardly to intersect the vertical shoulder above the planar upper jaw surface thereby forming a positioning body portion bounded by the planar upper surface extending from the rear end, the bottom, the rearward end and the vertical upstanding shoulder, generally parallel sides connecting the bottom with the flat upper surface and the planar upper surface to form a generally rectangular vise lower jaw, an upper jaw adjustably mounted on the lower jaw, said upper jaw comprising a forward end and a rearward end, a top extending from end to end, a flat bottom surface extending from end to end to form bottom jaw surface generally coextensive with the flat upper jaw surface, generally parallel sides connecting the top and bottom surface to form a generally rectangular vise upper jaw, screw means adjacent the forward ends of the upper and lower vise jaws to control and vary the parallel space between the confronting jaw surfaces, screw means carried by one of the jaws adjacent the rearward end thereof to engage the confronting jaw surface of the other jaw to cause pivoting of one jaw with respect to the other about the screw means adjacent the forward ends of the jaws, the rearward end of the lower jaw being provided with a central recess bounded by vertical shoulders extending throughout the height thereof, a guide bracket fitted into said recess and affixed to the rearward end of the lower jaw, said guide bracket being adapted for use in sharpening of scissor blades and comprising a support portion from which angularly extends an arm portion having a body portion, a guide bar extending transversely from the body portion, said guide bar being provided with a guide slot extending substantially throughout its width, the support portion being sized to fit into the central recess in the rearward end of the lower jaw, means for affixing the support portion to the lower jaw in the aforesaid central recess, so that said guide slot is parallel to the scissors blade adapted for securement between and by the upper and lower jaws, a sharpening tool cooperating with the blade sharpening device, said tool comprising a longitudinally extending base having a square cross section, thereby forming four equi-sized side faces, at least one of said faces being provided with an abrasive stone sized to be coextensive with said side face, one end of the base being provided with a centrally threaded hole, a guide rod having a threaded end mounted in said threaded hole whereby every abrasive stone mounted on the side faces will be equidistant from the center of the base, the guide rod fitting in and passing through one of the guide slots to control the angle of the abrasive stone with respect to a plane projected outwardly from between the confronting surfaces of the upper and lower jaws, whereby when a blade is held between the upper and lower jaws the blade will be positioned in the aforesaid plane so that the angle of sharpening will be determined by the transverse guide slot in which the guide rod is positioned.

5. The invention as set forth in claim 4 and wherein the arm portion is sized to fit into the central recess in the rearward end of the lower jaw and is provided with at least one hole whereby suitable fastening means may secure the arm portion to the rearward end of the lower jaw to thereby convert the device to one adapted for knife blade sharpening.

* * * * *